US009360788B2

(12) United States Patent
Kamata et al.

(10) Patent No.: US 9,360,788 B2
(45) Date of Patent: Jun. 7, 2016

(54) ROLLER MEMBER, ROLLER SUPPORTING MECHANISM, AND IMAGE FORMING APPARATUS

(71) Applicant: CANON KABUSHIKI KAISHA, Tokyo (JP)

(72) Inventors: Kohki Kamata, Machida (JP); Motomi Suzuki, Kashiwa (JP); Haruyasu Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/673,554

(22) Filed: Mar. 30, 2015

(65) Prior Publication Data

US 2015/0277266 A1 Oct. 1, 2015

(30) Foreign Application Priority Data

Mar. 31, 2014 (JP) ..... 2014-074542

(51) Int. Cl.
*G03G 15/02* (2006.01)
*G03G 15/08* (2006.01)
*G03G 15/00* (2006.01)

(52) U.S. Cl.
CPC ..... *G03G 15/0233* (2013.01); *G03G 15/0818* (2013.01); *G03G 15/6529* (2013.01)

(58) Field of Classification Search
CPC ..... G03G 15/0233; G03G 15/0808; G03G 15/6529
See application file for complete search history.

(56) References Cited

U.S. PATENT DOCUMENTS 8,515,305 B2 * 8/2013 Nonaka ..... G03G 15/0258 399/100
2007/0036606 A1 * 2/2007 Takeshita ..... B41J 3/4071 400/642
2010/0206191 A1 * 8/2010 Saito ..... B41J 13/076 101/216
2012/0057924 A1 * 3/2012 Yamanaka ..... B43K 1/06 401/222

FOREIGN PATENT DOCUMENTS

JP 2010-230748 A 10/2010
JP 2013-109209 A 6/2013

* cited by examiner

*Primary Examiner* — G. M. Hyder
(74) *Attorney, Agent, or Firm* — Canon USA, Inc., IP Division

(57) ABSTRACT

A roller member used in an image forming apparatus includes a metallic shaft. The metallic shaft includes a cylindrical portion formed so that one end portion and an other end portion of the metallic plate oppose each other and a projecting portion projecting from an end surface of the cylindrical portion outward in an axial direction of the metallic shaft. The projecting portion includes an end surface located at an end of the projecting portion in the axial direction and an inclined surface configured to connect the end surface of the projecting portion and the end surface of the cylindrical portion. The inclined surface is inclined with respect to the axial direction of the metallic shaft by extending outward from the end surface of the projecting portion in a circumference direction of the cylindrical portion.

13 Claims, 13 Drawing Sheets

ROLLER MEMBER, ROLLER SUPPORTING MECHANISM, AND IMAGE FORMING APPARATUS

BACKGROUND OF THE INVENTION

1. Field of the Invention

This disclosure relates to a roller member used for an image forming apparatus, a roller supporting mechanism provided with the roller member, and the image forming apparatus.

An image forming apparatus is an apparatus that forms images on recording media. Examples of an electrophotographic image forming apparatus include, for example, electrophotographic copying machines, electrophotographic printers (LED printers, laser beam printers), facsimile apparatuses, and word processors.

2. Description of the Related Art

In the related art, an electrophotographic image forming apparatus (hereinafter, referred to as an image forming apparatus) is provided with a process device having a photo sensitive drum (electrophotographic photosensitive drum) and acting on the photosensitive drum. Examples of the process device include a voltage application apparatus configured to apply electric charge on the photosensitive drum, a developing device configured to supply developer (hereinafter, referred to as "toner") to the photosensitive drum, and a cleaning device configured to clean toner failed to be transferred and remaining on a surface of the photosensitive drum.

Examples of a charging device in the voltage application apparatus include a roller charging system using a roller member. In the roller charging system, charging of the surface of the photosensitive drum is achieved by bringing a charging roller, which is a conductive resilient roller, into bias abutment with the photosensitive drum and applying a voltage thereto. The charging roller generally has a form having a resilient layer covering a metallic shaft over the entire area in a longitudinal direction other than both ends (Japanese Patent Laid-Open No. 2013-109209).

Examples of the metallic shaft of the charging roller include a form using a cylindrical-shaped metallic shaft (Japanese Patent Laid-Open No. 2010-230748).

However, in the cylindrical-shaped metallic shaft formed by a press work may have a projecting portion present on an end surface of the metallic shaft by a requirement in a manufacturing process. In this case, if the metallic shaft is rotatably supported by a bearing portion, the projecting portion may be caught by the bearing portion and hence abrasion of the bearing portion may be accelerated. Alternatively, smooth rotation of the roller member may be impaired by the projecting portion.

Therefore, resisting abrasion of the bearing by rotation of the roller member or rotating the roller member smoothly is currently required.

SUMMARY OF THE INVENTION

A representative configuration disclosed in this application is a roller member used in an image forming apparatus. The roller member includes a metallic shaft. The metallic shaft includes a cylindrical portion formed so that one end portion and an other end portion of the metallic plate oppose each other and a projecting portion projecting from an end surface of the cylindrical portion outward in an axial direction of the metallic shaft. The projecting portion includes an end surface located at an end of the projecting portion in the axial direction and an inclined surface configured to connect the end surface of the projecting portion and the end surface of the cylindrical portion. The inclined surface is inclined with respect to the axial direction of the metallic shaft by extending outward from the end surface of the projecting portion in a circumference direction of the cylindrical portion.

Further features of the present invention will become apparent from the following description of exemplary embodiments with reference to the attached drawings.

DESCRIPTION OF THE EMBODIMENTS

An embodiment of this disclosure will be described with reference to the drawings in detail.

A direction of a rotational axis of an electrophotographic photosensitive drum is defined as a longitudinal direction.

In the longitudinal direction, a side where the electrophotographic photosensitive drum receives a driving force from an image forming apparatus body is defined as a driving side (on a drive force receiving portion 63*a* side in FIG. 6), and a side opposite thereto is defined as a non-driving side.

Figure 2:
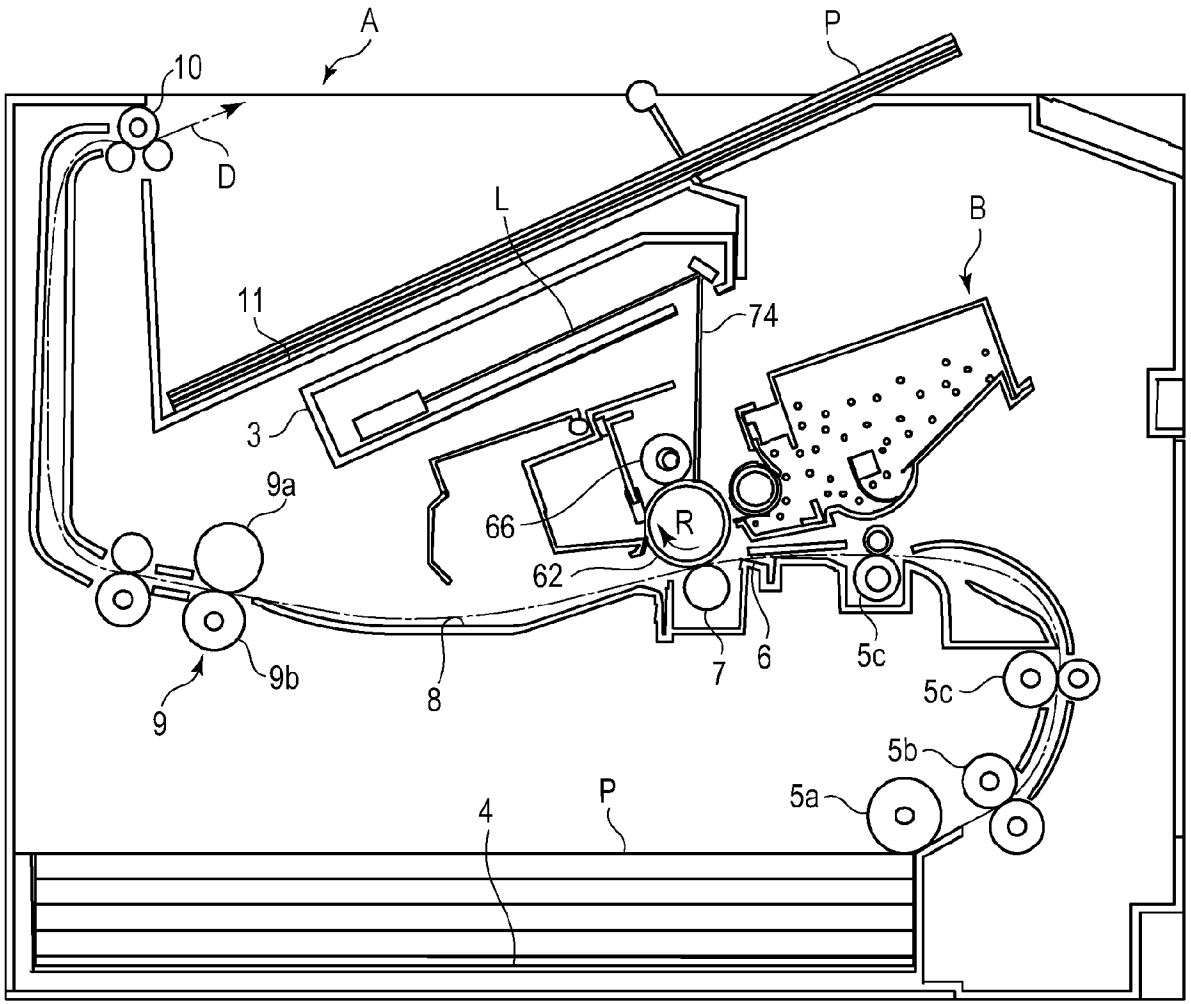
FIG. 2 is a cross-sectional view illustrating an image forming apparatus body and a process cartridge of an electrophotographic image forming apparatus of Example 1.
Figure 3:
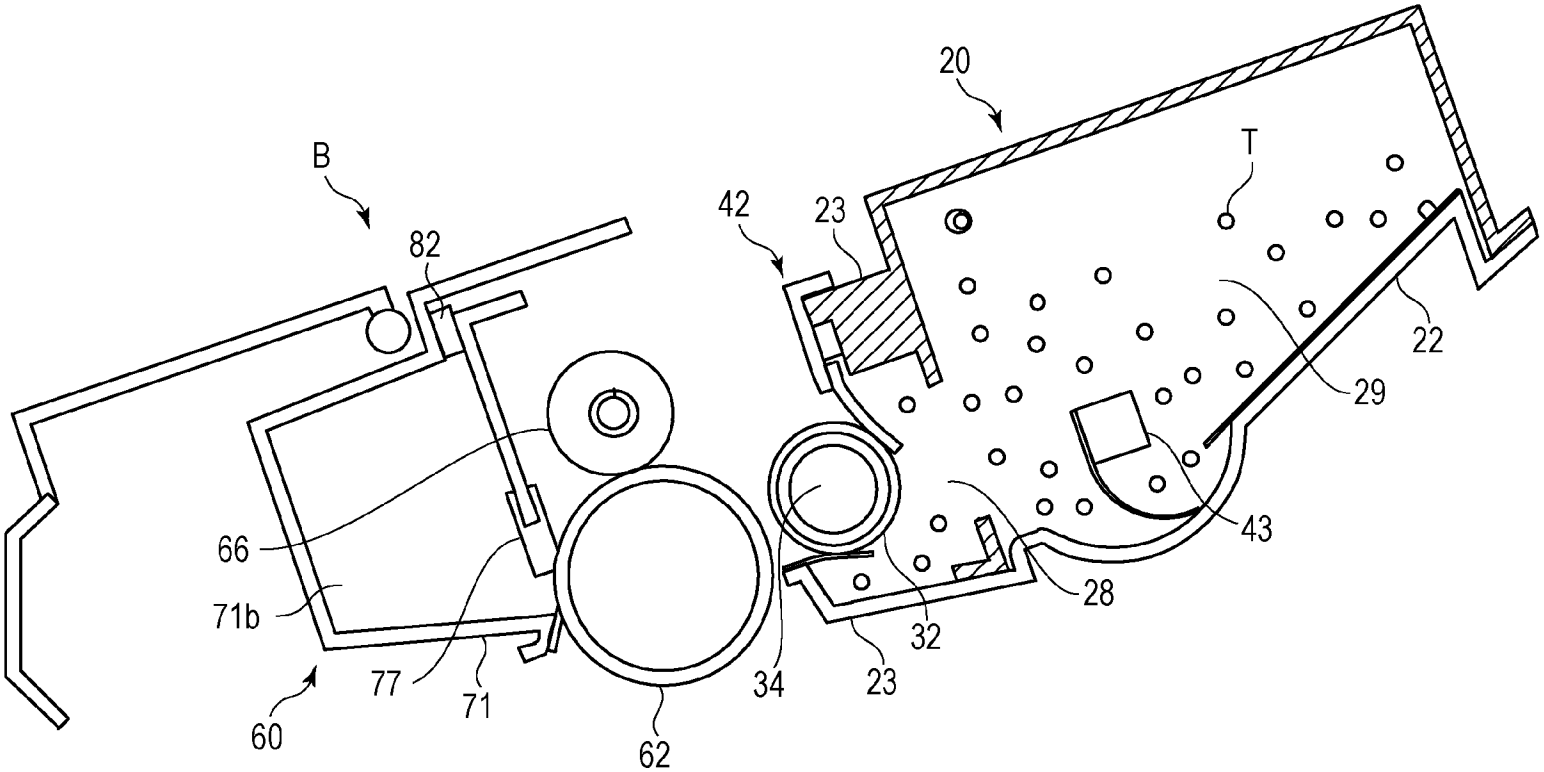
FIG. 3 is a cross-sectional view illustrating the process cartridge of Example 1.
Figure 4:
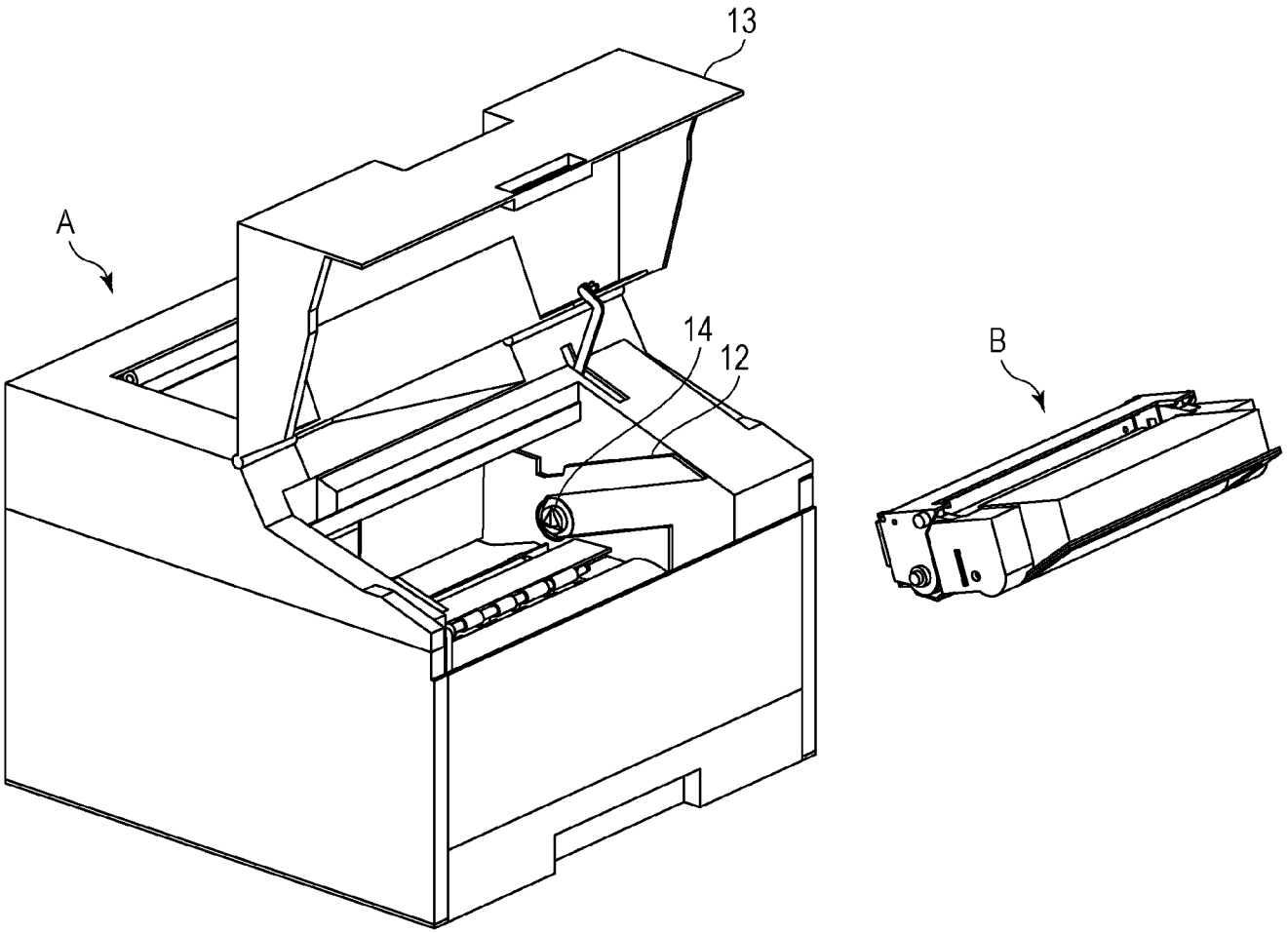
FIG. 4 is a perspective view illustrating the image forming apparatus body and the process cartridge of Example 1 in a state in which an opening and closing door is opened.

With reference to FIG. 2, FIG. 3, and FIG. 4, a general configuration and an image forming process will be described.

FIG. 2 is a cross-sectional view illustrating the image forming apparatus body (hereinafter, referred to as an apparatus body A) of the electrophotographic image forming apparatus and a process cartridge (hereinafter, referred to as a cartridge B) as an embodiment of this disclosure.

FIG. 3 is a cross-sectional view illustrating the cartridge B.

Here, the apparatus body A of the electrophotographic image forming apparatus is a portion of the electrophotographic image forming apparatus from which the cartridge B is removed.

FIG. 4 is a perspective view illustrating the image forming apparatus body A and the process cartridge B.

General Configuration of Electrophotographic Image Forming Apparatus

In FIG. 2 and FIG. 4, the electrophotographic image forming apparatus is a laser beam printer using an electrophotographic technology in which the cartridge B is demountably mounted on the apparatus body A. When the cartridge B is mounted on the apparatus body A, an exposure unit 3 (laser scanner unit) is arranged in an upper side of the cartridge B.

Also, a sheet tray 4 in which a recording medium (hereinafter, referred to as a sheet material P) which is a target of image formation (medium on which images are to be recorded) is stored on a lower side of the cartridge B is arranged.

In addition, the apparatus body A includes a pickup roller 5*a*, a feed roller pair 5*b*, a conveyance roller pair 5*c*, a transfer guide 6, a transfer roller 7, a conveyance guide 8, a fixing unit 9, a discharging roller pair 10, and a discharge tray 11 arranged in sequence along a direction of conveyance of the sheet material P. The fixing unit 9 includes a heat roller 9*a* and a pressurizing roller 9*b*.

Image Forming Process

Subsequently, the image forming process is described schematically. On the basis of a print start signal, the electrophotographic photosensitive drum (hereinafter, referred to as a drum 62) is driven to rotate at a predetermined circumferential velocity (process speed) in a direction indicated by an arrow R.

A charging roller 66 to which a bias voltage is applied, comes into contact with an outer peripheral surface of the drum 62, and charges the outer peripheral surface of the drum 62 uniformly and evenly. In other words, the charging roller 66 is a conductive roller member (conductive roller).

The exposure unit 3 outputs a laser beam L in accordance with image information. The laser beam L passes through an exposure window portion 74 on an upper surface of the cartridge B, and scans and exposes the outer peripheral surface of the drum 62.

Accordingly, an electrostatic latent image corresponding to the image information is formed on the outer peripheral surface of the drum 62.

In contrast, as illustrated in FIG. 3, in a developing assembly unit 20 as a developing assembly, toner T in a toner chamber 29 is stirred and conveyed by a rotation of a conveyance member 43 and fed to a toner supply chamber 28. The toner T is born on a surface of a developing roller 32 by a magnetic force of a magnet roller 34 (fixed magnet). The toner T is controlled in layer thickness on a peripheral surface of the developing roller 32 while being charged by friction by a developing blade 42.

The toner T is transferred to the drum 62 in accordance with the electrostatic latent image, and is visualized as a toner image.

The drum 62 is an image bearing member configured to bear images (a toner image, a developer image) on the surface thereof. The developing roller 32 is a developer bearing member configured to bear developer (toner) for developing a latent image formed on the drum 62 as a toner image (developer image).

As illustrated in FIG. 2, the sheet material P stored in a lower portion of the apparatus body A is fed from the sheet tray 4 by the pickup roller 5*a*, the feed roller pair 5*b*, and the conveyance roller pair 5*c* at the same timing as outputting of the laser beam L. The pickup roller 5*a*, the feed roller pair 5*b*, and the conveyance roller pair 5*c* are conveyance mechanism configured to convey the recording medium (sheet material P).

Then, the sheet material P passes through the transfer guide 6, and is fed to a transfer position between the drum 62 and the transfer roller 7. At this transfer position, the toner images are transferred in sequence from the drum 62 to the sheet material P.

The sheet material P to which the toner image is separated from the drum 62 and conveyed to the fixing unit 9 along the conveyance guide 8. The sheet material P then passes through a nip portion between the heat roller 9*a* and the pressurizing roller 9*b* which constitute part of the fixing unit 9.

At the nip portion, pressurization and heat-fixation are performed, so that the toner image is fixed to the sheet material P. The sheet material P subjected to the fixation of the toner image is conveyed to the discharging roller pair 10, and is discharged to the discharge tray 11.

In contrast, as illustrated in FIG. 3, residual toner on the outer peripheral surface of the drum 62 after the transfer is removed by a cleaning blade 77, and the drum 62 is used for the image forming process again. The toner removed from the drum 62 is stored in a waste toner chamber 71*b* of a cleaning unit 60.

In the above, the charging roller 66, the developing roller 32, and the cleaning blade 77 are process devices configured to act on the drum 62.

General Configuration of Cartridge

Subsequently, a general configuration of the cartridge B will be described with reference to FIG. 3 and FIG. 5.

Figure 5:
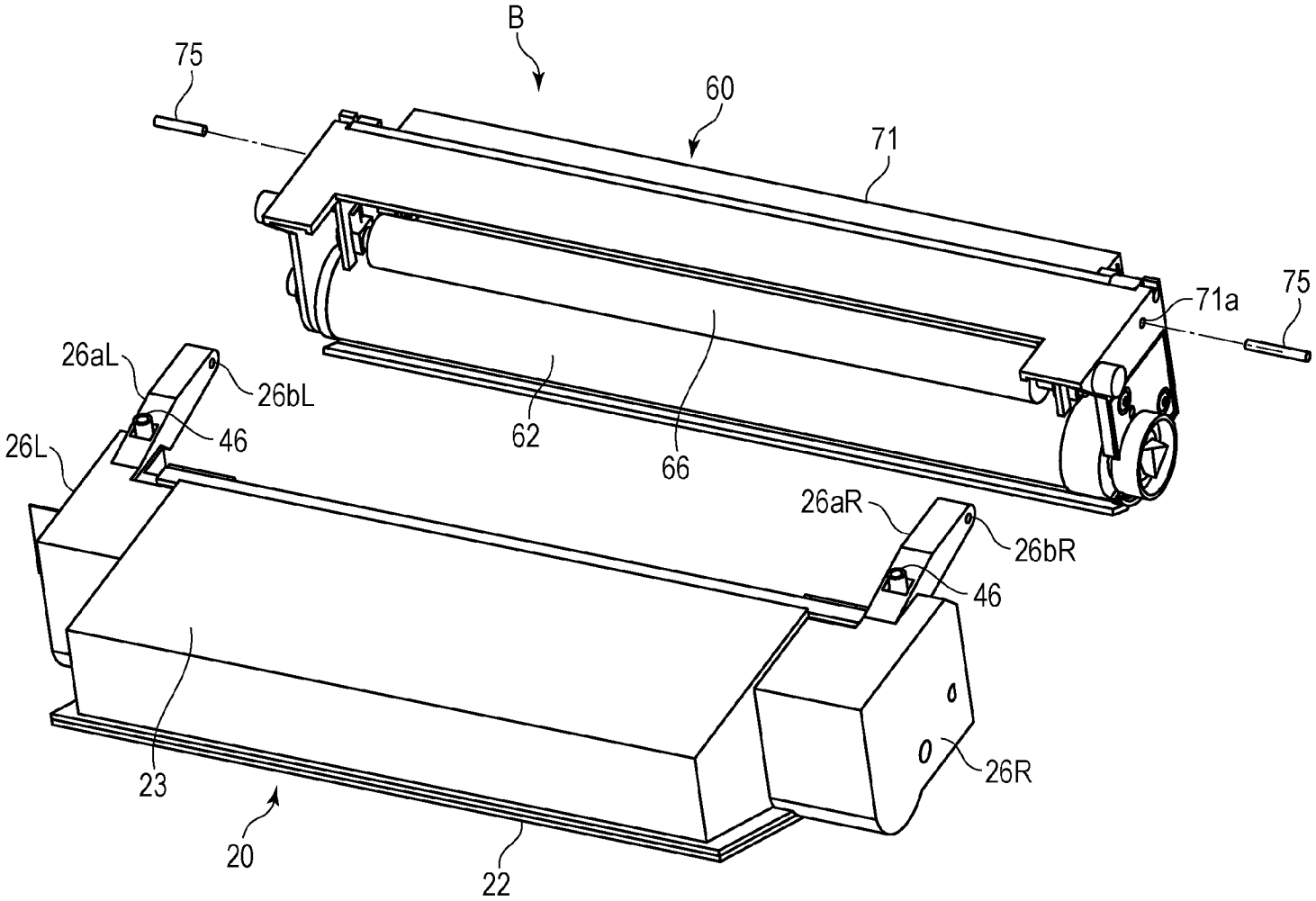
FIG. 5 is an explanatory perspective view illustrating a configuration of the process cartridge of Example 1.

FIG. 5 is an explanatory perspective view illustrating a configuration of the cartridge B.

The cartridge B includes the cleaning unit 60 and the developing assembly unit 20 combined with each other.

The cleaning unit 60 includes a cleaning frame member 71, the drum 62, the charging roller 66, and the cleaning blade 77.

In contrast, the developing assembly unit 20 includes a bottom member 22, a developer container 23, a first side member 26L, a second side member 26R, the developing blade 42, the developing roller 32, the magnet roller 34, the conveyance member 43, the toner T, and biasing members 46.

The cartridge B is formed by coupling the cleaning unit 60 and the developing assembly unit 20 with a coupling member 75 so as to be rotatable with each other.

Specifically, rotary hole 26*b*L and 26*b*R, extending in parallel with the developing roller 32, are formed at distal ends of arm portion 26*a*L and 26*a*R formed on the first side member 26L and the second side member 26R provided on the developing assembly unit 20 at both end portions thereof in a longitudinal direction (an axial direction of the developing roller 32).

Fitting holes 71*a* for fitting coupling members 75 are formed at both end portions of the cleaning frame member 71 in the longitudinal direction.

The arm portion 26*a*L and 26*a*R are aligned with predetermined positions of the cleaning frame member 71 to insert the coupling member 75 into the rotary holes 26*b*L and 26*b*R and the fitting hole 71*a*. Accordingly, the cleaning unit 60 and the developing assembly unit 20 are coupled so as to be rotatable about the coupling member 75 as a center.

At this time, the biasing members 46 mounted at roots of the arm portions 26*a*L and 26*a*R abut against the cleaning frame member 71, thereby biasing the developing assembly unit 20 toward the cleaning unit 60 about the coupling members 75 as a center of rotation.

Accordingly, the developing roller 32 is reliably pressed in the direction of the drum 62.

With distance retaining members (which are not illustrated) mounted on both end portions of the developing roller 32, the developing roller 32 is retained at a predetermined distance from the drum 62.

Configuration of Cleaning Unit

Subsequently, a configuration of the cleaning unit 60 will be described with reference to FIG. 6, FIGS. 7A and 7B, and FIG. 8.

Figure 6:
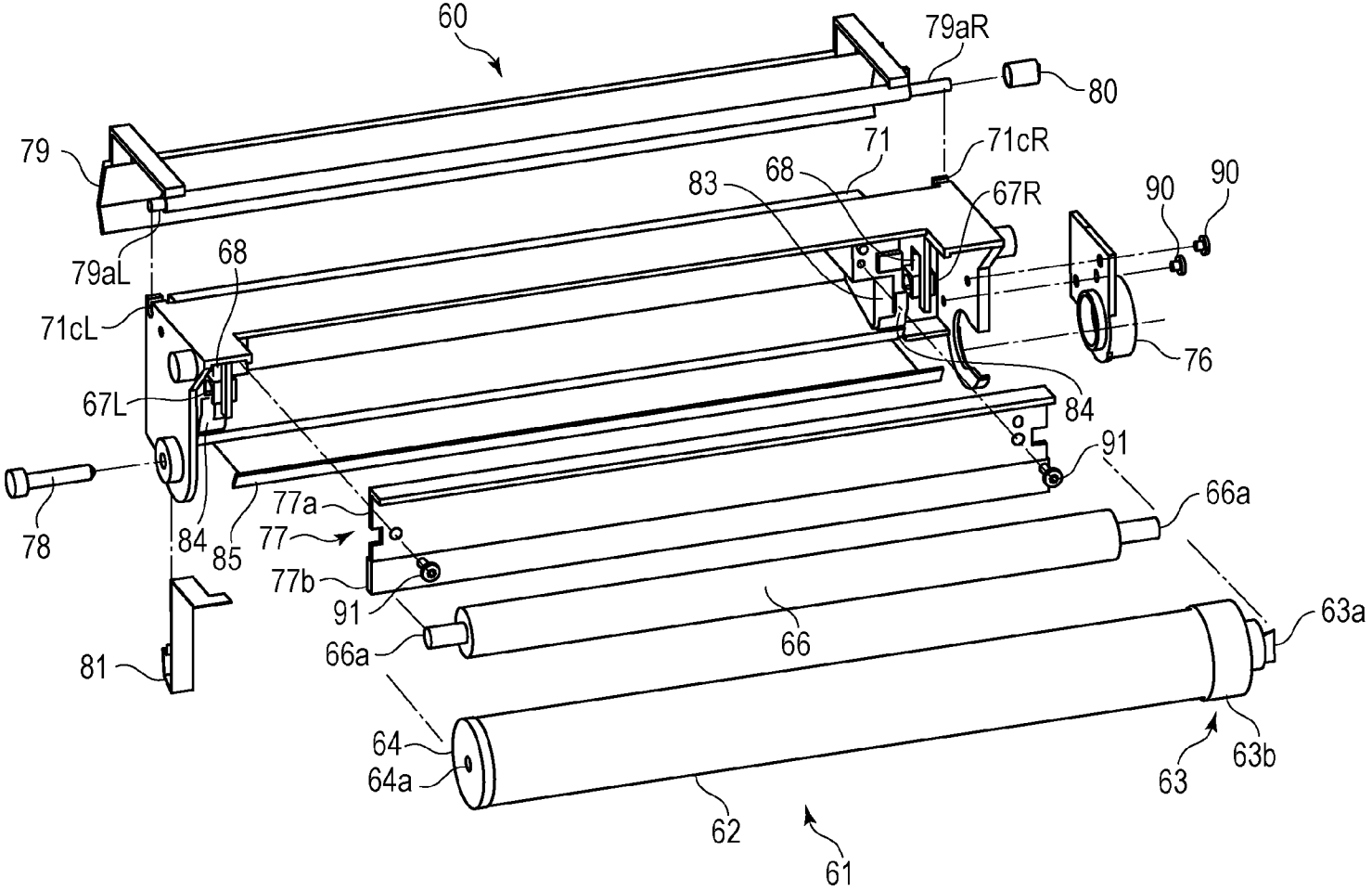
FIG. 6 is an explanatory perspective view illustrating a configuration of a cleaning unit of Example 1.

FIG. 6 is an explanatory perspective view illustrating the configuration of the cleaning unit 60.

Figure 7A:
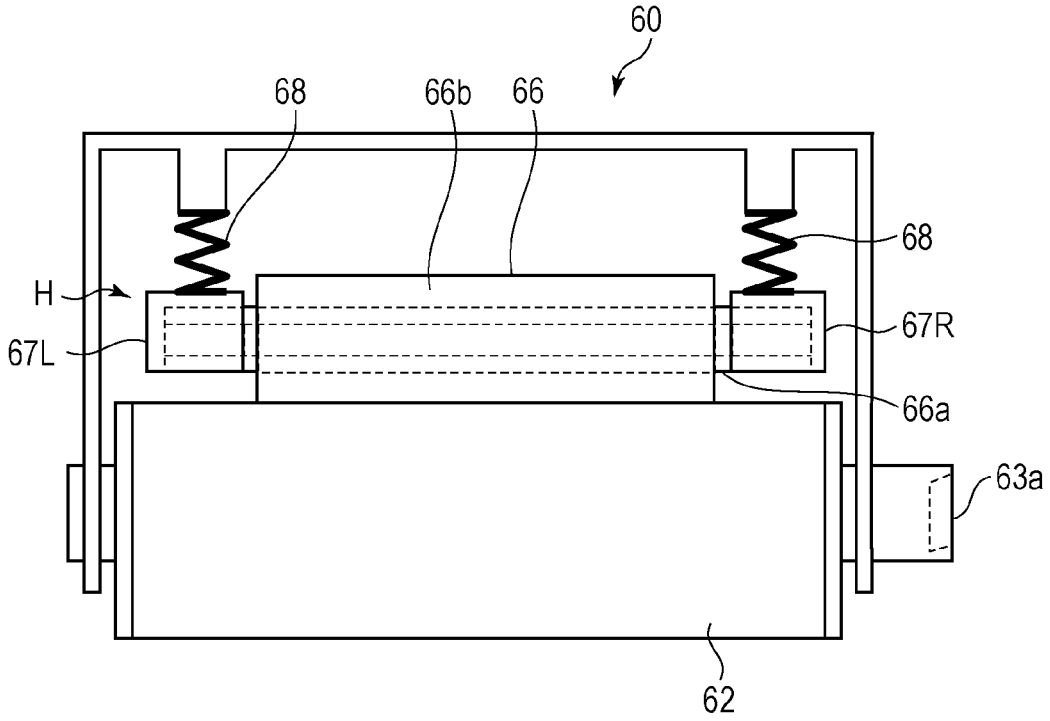
FIGS. 7A and 7B are explanatory views illustrating the configuration of the cleaning unit of Example 1.
Figure 7B:
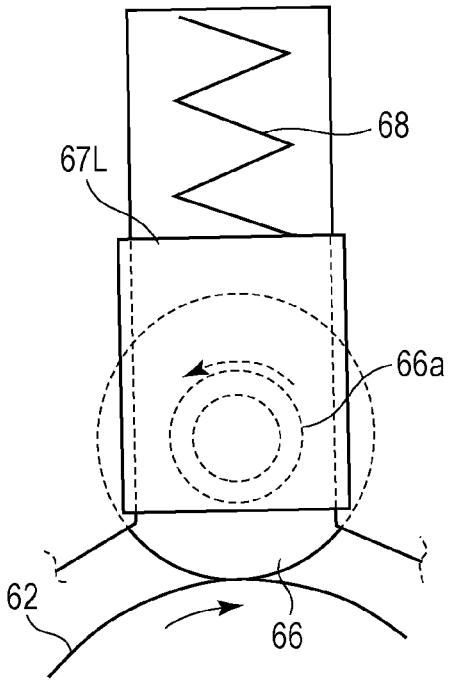
Figure 8:
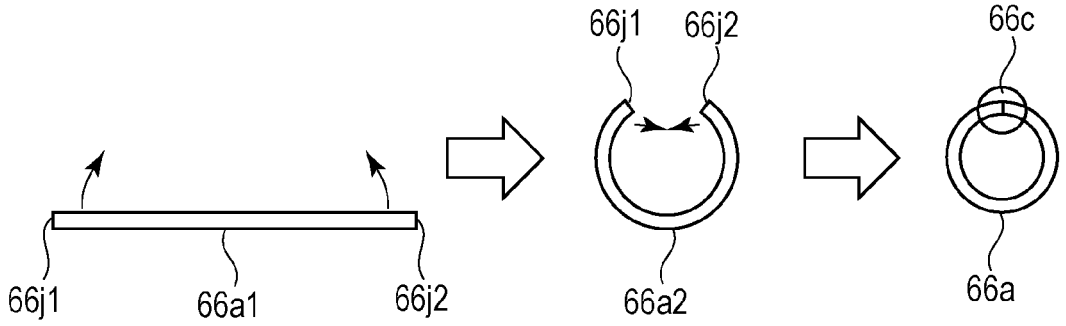
FIG. 8 is an explanatory cross-sectional view illustrating a processing process of a charging roller of Example 1.

FIG. 7A is an explanatory front view illustrating the configuration of the cleaning unit 60. FIG. 7B is a drawing illustrating a supporting portion of the charging roller 66 viewed in a direction indicated by an arrow H. FIG. 8 is a cross-sectional view illustrating a process of formation of a shaft portion 66*a* from a plate into a cylindrical shape.

The cleaning blade 77 includes a supporting member 77*a* formed of a plate and a resilient member 77*b* formed of a resilient material such as urethane rubber, and is arranged at a predetermined position in the cleaning frame member 71 by fixing both ends of the supporting member 77*a* with screws 91.

Resilient member 77*b* comes into abutment with the drum 62, and removes residual toner from the outer peripheral surface of the drum 62.

The removed toner is stored in a waste toner chamber 71*b* (FIG. 3) of the cleaning unit 60.

A first seal member 82, a second seal member 83, a third seal member 84, and a fourth seal member 85 are fixed to predetermined positions of the cleaning frame member 71 with double-sided tape and the like.

The first seal member 82 is provided across the longitudinal direction and prevents wasted toner from leaking from a back side of the supporting member 77*a* of the cleaning blade 77.

The second seal member 83 prevents wasted toner from leaking from both ends of the resilient member 77*b* of the cleaning blade 77 in the longitudinal direction.

The third seal member 84 wipes adhered substances such as toner on the drum 62 while preventing the wasted toner from leaking out from the both ends of the resilient member 77*b* of the cleaning blade 77 in the longitudinal direction.

The fourth seal member 85 is provided in contact with the drum 62 across the longitudinal direction, and prevents the wasted toner from leaking out from the upstream side of the drum 62 in a direction of rotation with respect to the cleaning blade 77.

An electrode plate 81, a biasing member 68, and charging roller bearings (bearing portions) 67L and 67R are mounted on the cleaning frame member 71.

A metallic shaft (hereinafter, referred to as the shaft portion 66*a*) of the charging roller 66 is fitted to the charging roller bearings 67L and 67R.

The charging roller 66 is biased by the biasing member 68 with respect to the drum 62, and is rotatably supported by the charging roller bearings 67L and 67R. The biasing member 68 is driven to rotate in association with the rotation of the drum 62. In other words, the charging roller 66 is supported by the cleaning unit 60 via charging roller bearings 67 (67L and 67R). The cleaning unit 60 is a roller supporting mechanism configured to support the charging roller 66.

The charging roller 66 is configured by covering the hollow shaft portion 66*a* with a conductive resilient layer (covering layer) 66*b* over the entire area in the longitudinal direction except for both ends. The shaft portion 66*a* has a cylindrical shape (roller shape). The shaft portion 66*a* is a conductive metallic shaft formed of a metal.

The resilient layer 66*b* and the shaft portion 66*a* are joined by an adhesive agent. The shaft portion 66*a* is a member formed a conductive metallic plate such as a stainless steel plate or a galvanized steel plate into a cylindrical shape by a press work. Here, using the hollow shaft portion 66*a* formed by a press work is used is to achieve a weight reduction of the charging roller 66, the cartridge having the charging roller 66, and the image forming apparatus by reducing the weight of the shaft portion 66*a*. If the shaft portion 66*a* can be formed by processing the metallic plate, a cost reduction of the shaft portion 66*a* is achieved.

The electrode plate 81, the biasing member 68, the charging roller bearing 67L, and the shaft portion 66*a* have conductivity. The electrode plate 81 is in contact with a power feeding portion (which is not illustrated) of the apparatus body A. With these members using as a power feeding route, power is supplied to the charging roller 66.

The drum 62 is coupled integrally with a flange 64 and a flange 63 to achieve an electrophotographic photosensitive drum unit (hereinafter, referred to as a drum unit 61). This coupling method uses caulking, adhesion, welding, and the like.

An earth contact point and the like (which is not illustrated) is coupled to the flange 64. The flange 63 includes a drive force receiving portion 63*a* configured to receive a drive force from the apparatus body A and a flange gear portion 63*b* configured to transmit the driving force to the developing roller 32.

A bearing member 76 is integrally fixed to a driving side of the cleaning frame member 71 with a screw 90, and a drum shaft 78 is fixed to a non-driving side of the cleaning frame member 71 by press fitting.

The bearing member 76 fits the flange 63, and the drum shaft 78 fits a hole 64*a* of the flange 64.

Accordingly, the drum unit 61 is rotatably supported by the cleaning frame member 71.

A protecting member 79 is rotatably supported by the cleaning frame member 71 so that a protection (light-shielding) of the drum 62 and exposure are allowed.

A biasing member 80 is mounted on a shaft portion 79*a*R on a driving side of the protecting member 79, and biases the protecting member 79 in a direction to protect the drum 62.

A shaft portion 79*a*L on a non-driving side and the shaft portion 79*a*R on the driving side of the protecting member 79 fit bearing portions 71*c*L and 71*c*R of the cleaning frame member 71.

Configuration of Charging Roller

A configuration of the charging roller 66 will be described with reference to FIG. 1, FIG. 8, FIGS. 9A and 9B, FIG. 10, FIG. 11, and FIG. 12.

Figure 1:
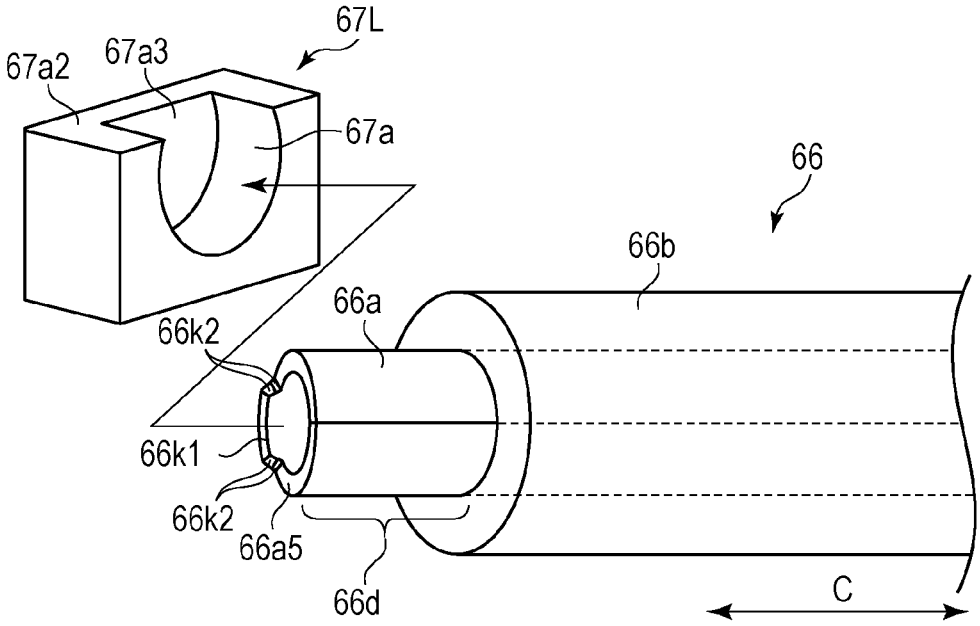
FIG. 1 is a perspective view illustrating a charging roller of Example 1.

FIG. 1 is a perspective view illustrating the charging roller 66 and the charging roller bearing 67L.

Figure 9A:
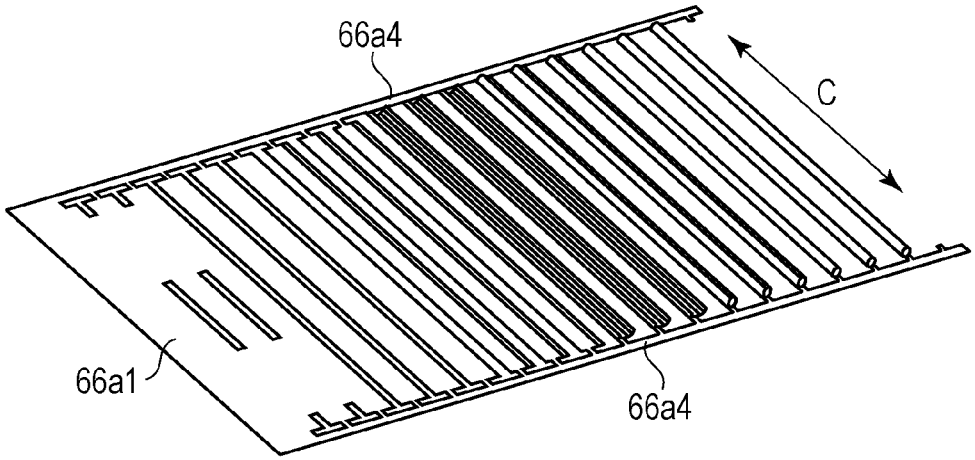
FIGS. 9A and 9B are process layout drawings of a normal feed press work for forming the metallic plate into a cylindrical shape.

FIG. 9A is a perspective view illustrating a process layout of a normal feed press work for forming the metallic plate into a cylinder.

Figure 9B:
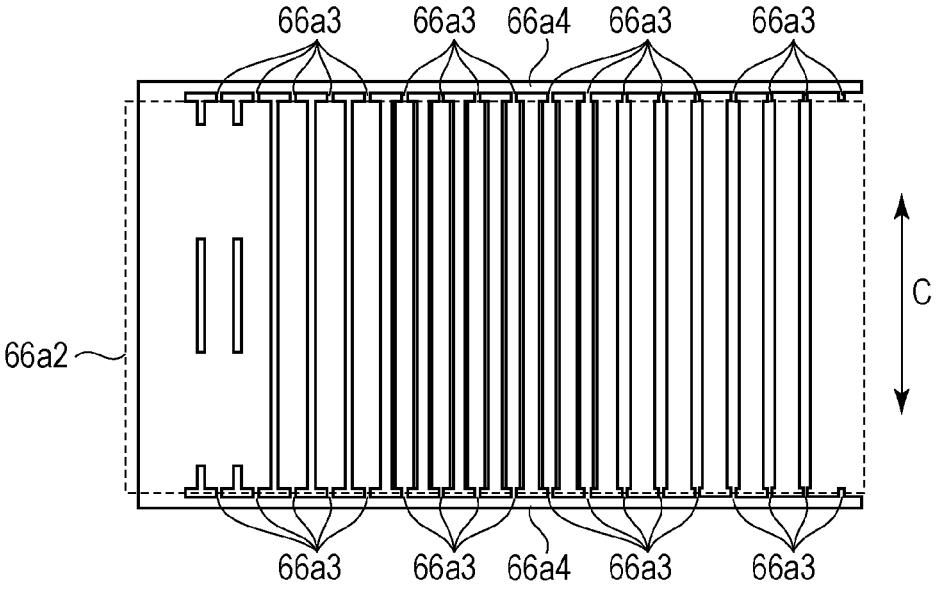

FIG. 9B is a plan view illustrating the process layout of the normal feed press work for forming the metallic plate into a cylindrical shape.

Figure 10:
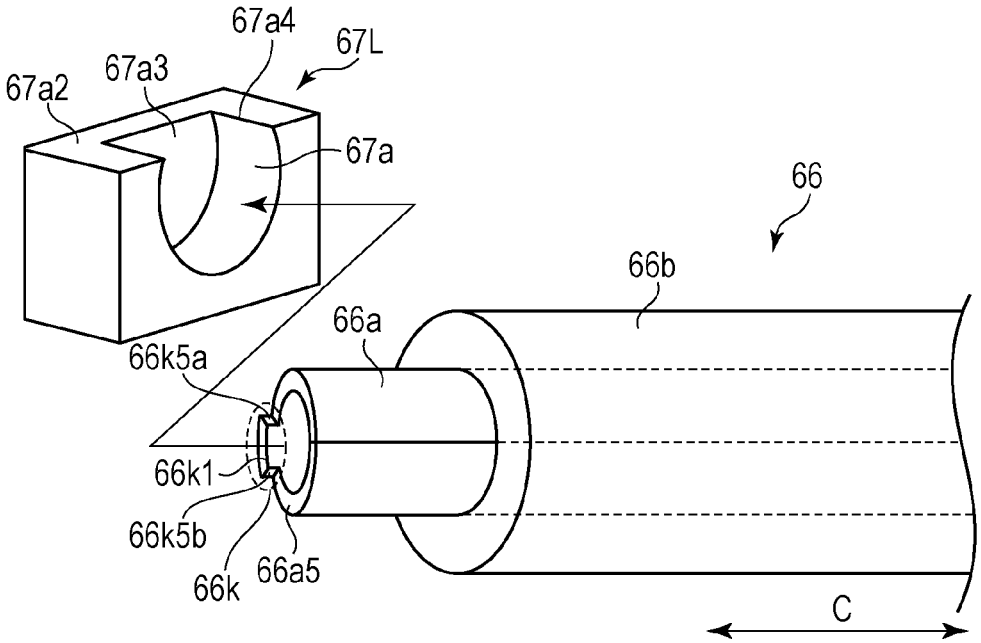
FIG. 10 is an explanatory view illustrating the charging roller as a comparative example.

FIG. 10 is a perspective view illustrating the charging roller 66 and the charging roller bearing 67L in which this disclosure is not implemented.

Figure 11:
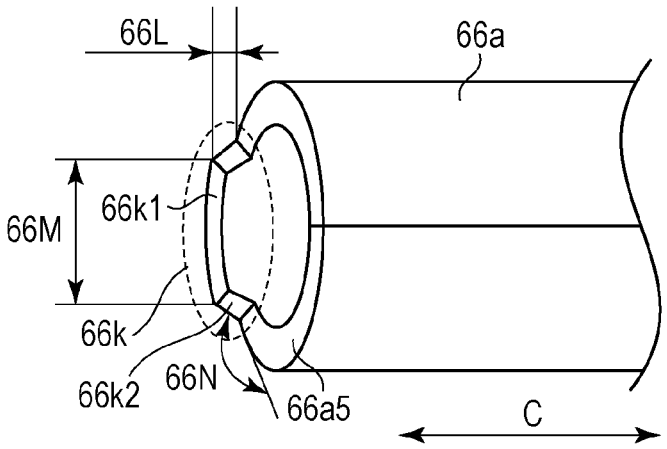
FIG. 11 is a detailed drawing illustrating an end portion of a shaft portion of the charging roller of Example 1.

FIG. 11 is a detailed drawing illustrating an end portion of the shaft portion 66*a* of the charging roller of Example 1.

Figure 12:
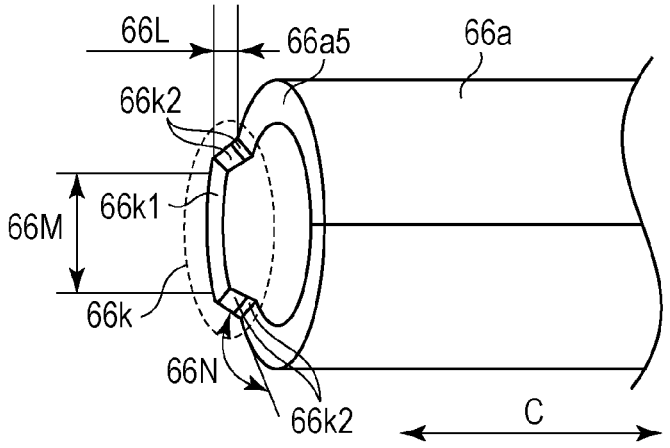
FIG. 12 is a detailed drawing illustrating the end portion of the shaft portion of the charging roller of another form of Example 1.

FIG. 12 is a detailed drawing illustrating the end portion of the shaft portion 66*a* of the charging roller of another form of Example 1.

The shaft portion 66*a* of the charging roller 66 as illustrated in FIG. 8, and FIGS. 9A and 9B is a member formed by bending and pressing the conductive metallic plate 66*a*1 into a cylindrical shape in outer diameter. The metallic plate 66*a*1 is bent so that one end portion (first end portion) 66*j*1 and an other end portion (second end portion) 66*j*2 oppose each other and is formed into a cylindrical shape (roller shape). An area in which the one end portion 66*j*1 and the other end portion 66*j*2 oppose each other (opposing area) corresponds to a mating portion 66*c* in the shaft portion 66*a*.

A method of forming the outer diameter by bending into a cylindrical shape by a press work will be described.

A normal feeding process, which is a general method of the press work, will be described as an example. In order to form the metallic plate 66*a*1 into a cylindrical shape, the metallic plate 66*a*1 having a width larger than the entire length of the shaft portion 66*a* of the charging roller in an axial direction C is used as a row material. In the metallic plate, a portion to be formed into a cylindrical shape (cylindrical shaped portion) 66*a*2 and cross pieces 66*a*4 integrally formed with the cylindrical shaped portion 66*a*2 by connecting portions 66*a*3 are required.

The cylindrical shaped portion 66*a*2 is supported by the cross pieces 66*a*4, and is conveyed intermittently, and a press work is performed on the cylindrical shaped portion 66*a*2 repeatedly. Accordingly, the metallic plate 66*a*1 is formed in sequence from step to step and, finally, the cylindrical shaped portion 66*a*2 is formed into a cylindrical shape.

After the cylindrical shaped portion 66*a*2 has become a cylindrical shape and shaping is completed, the portion 66*a*2 to be formed into the cylindrical shape is divided from the cross pieces 66*a*4 by cutting the connecting portions 66*a*3 in the metallic plate and a single shaft portion 66*a* of the charging roller is achieved.

In this case, the connecting portions 66*a*3 remain on both end surfaces of the shaft portion (cylindrical portion) 66*a* of the charging roller, and becomes a projection (projecting portion) 66*k* projecting form the shaft portion 66*a* of the charging roller outward in the axial direction C. An end surface located at an end of the projection 66*k* in the axial direction of the shaft portion 66*a* corresponds to a projecting surface 66*k*1.

As illustrated in FIG. 11, there are connecting surfaces 66*k*2 configured to couple (connect) an end surface of the shaft portion (an end surface of the cylindrical portion) 66*a*5 of the charging roller and the end surface (projecting surface 66*k*1) of the projection 66*k* projecting from the end surface 66*a*5. In this example, the connecting surfaces 66*k*2 are flat inclined surfaces (inclined planes).

In other words, the connecting surfaces 66*k*2 extends further outward from the projecting surface 66*k*1 in a circumferential direction of the shaft portion 66*a* (direction along the circumference of a circle which forms an outline of the shaft portion 66*a*) and hence is inclined with respect to the axial direction C of the shaft portion 66*a*.

Figure 14:
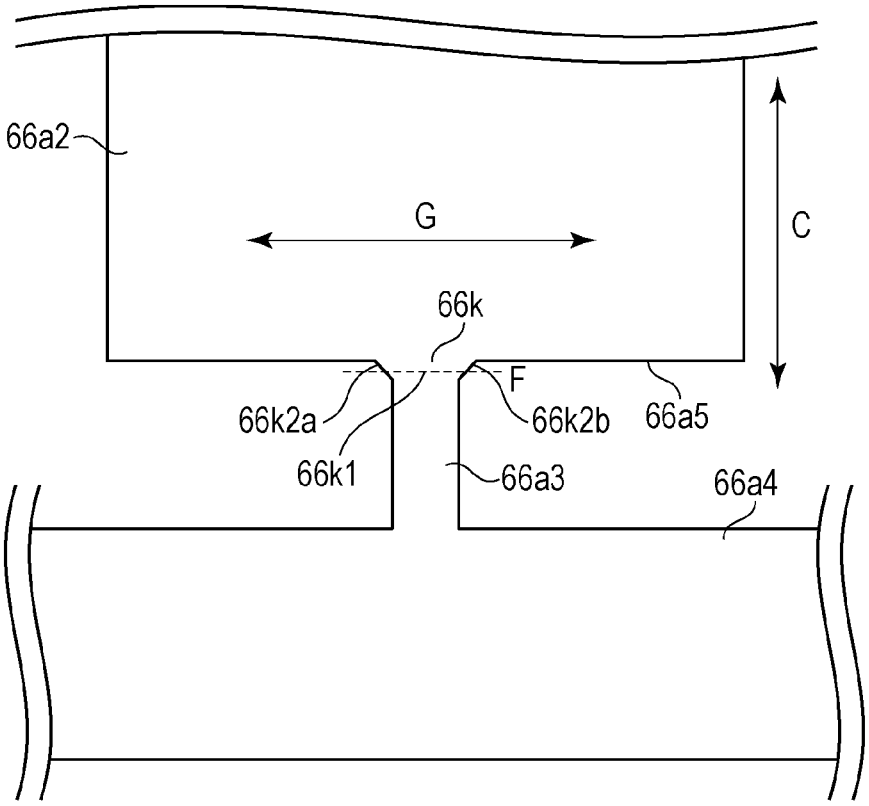
FIG. 14 is an enlarged drawing of the metallic plate.

FIG. 14 is an enlarged view illustrating the metallic plate 66*a*1 (the connecting portions 66*a*3, the cross pieces 66*a*4, and the cylindrical shaped portion 66*a*2) in the course of press work. After the cylindrical shaped portion 66*a*2 is rounded from the state illustrated in FIG. 14, the connecting portions 66*a*3 are to be cut along a line F. The line F is positioned outside the end surface 66*a*5 of the cylindrical shaped portion 66*a*2 in the axial direction C, so that the projection 66*k* remains on the cylindrical shaped portion 66*a*2 as part of the connecting portions 66*a*3 after the cut along the line F.

A cross section after the connecting portions 66*a*3 are cut corresponds to the end surface of the projecting surface 66*k*1 (the projecting surface 66*k*1). Here, inclined surfaces inclined with respect to the axial direction C are formed between the end surface 66*a*5 of the cylindrical shaped portion 66*a*2 and the connecting portions 66*a*3 in advance. The inclined surfaces become the connecting surfaces 66*k*2 (66*k*2*a* and 66*k*2*b*) connected with the projection 66*k* when the connecting portions 66*a*3 are cut along the line F.

In other words, the connecting surfaces 66*k*2*a* and 66*k*2*b* extends from an area corresponding to the projecting surface 66*k*1 outward of the projecting surface 66*k*1 in a circumferential direction G so as to be connected to the end surface 66*a*5 of the cylindrical shaped portion 66*a*2 (shaft portion 66*a*).

By inclining the connecting surfaces 66*k*2 with respect to the axial direction C, abrasion of a bearing 67 occurring when the charging roller 66 rotates may be reduced.

Figure 15:
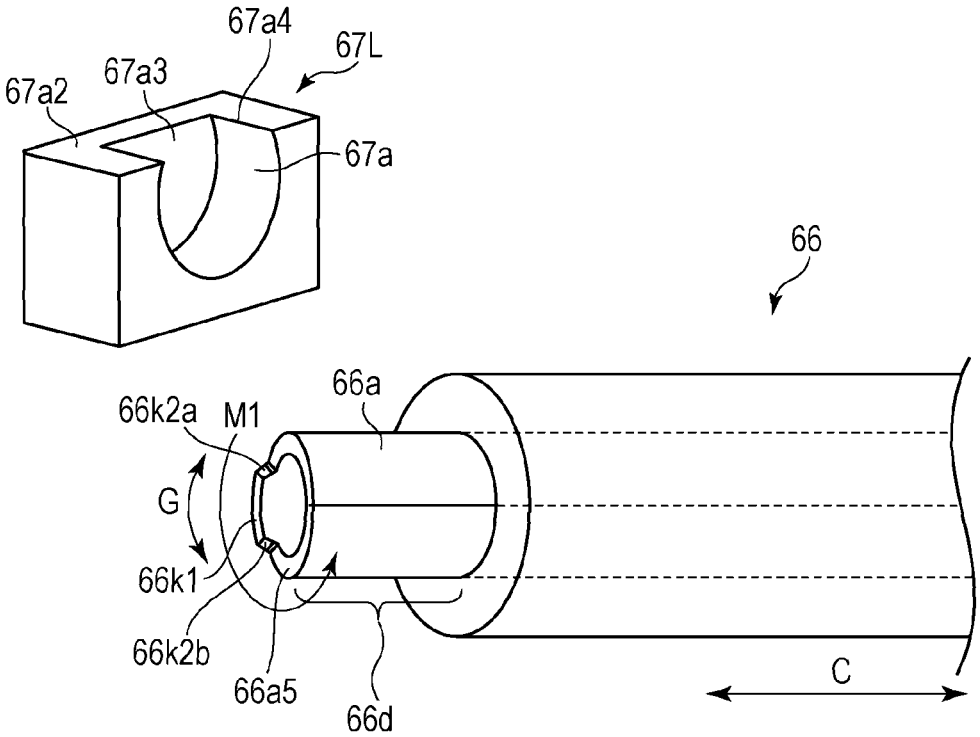
FIG. 15 is a perspective view illustrating the charging roller.

As illustrated in FIG. 15, in the circumference direction of the shaft portion 66*a*, the connecting surfaces 66*k*2*a* and the connecting surfaces 66*k*2*b* are provided respectively on both sides of the projecting surface 66*k*1. When the charging roller 66 rotates in a direction of an arrow M1, the connecting surface 66*k*2*b* located on the downstream side in the direction of rotation M1 out of the connecting surfaces 66*k*2*a* and 66*k*2*b* comes into contact intermittently with a ridge line 67*a*4 (comes into contact once in one rotation of the charging roller 66).

At this time, the ridge line 67*a*4 of the charging roller bearing 67 may receive a load from the connecting surface 66*k*2*b*. However, since the connecting surface 66*k*2*b* is inclined with respect to the axial direction C, the connecting surface 66*k*2*b* can hardly be caught by the ridge line 67*a*4, and the load applied to the ridge line 67*a*4 may be restrained. Therefore, even though the charging roller 66 rotates, a load that the charging roller bearing 67 receives is low, and hence lowering of the durability of the charging roller bearing 67 may be restrained. The connecting surfaces 66*k*2 can hardly be caught by the ridge line 67*a*4 when the connecting surfaces 66*k*2 come into contact with the charging roller bearing 67 by the rotation of the charging roller 66. Therefore, the rotation of the charging roller 66 is smoothly achieved. Consequently, a charging performance of the charging roller 66 is stabilized and hence an image quality is improved.

The connecting surface 66*k*2*a*, which is located on the upstream side of the direction of rotation M1, of the connecting surfaces 66*k*2 does not basically come into contact with the charging roller bearing 67. Therefore, in terms of restraining the abrasion of the charging roller bearing 67 or smoothing the rotation of the charging roller 66, the connecting surface 66*k*2*a* does not have to be an inclined surface.

In contrast, in terms of manufacture of the shaft portion 66*a* by pressing the metallic plate, the metallic plate preferably has a symmetric shape. In other words, the closer the shapes of the connecting surface 66*k*2*a* and the connecting surfaces 66*k*2*b*, the better the balance of the load exerted on the metallic plate at the time of the press work, so that processing accuracy is improved. In the case where a high degree of accuracy is required for the dimensions and the shape of the shaft portion 66*a*, the connecting surface 66*k*2*a*, which does not come into contact with the ridge line 67*a*4 of the charging roller bearing 67, is preferably inclined with respect to the axial direction C.

If the connecting surface 66*k*2*a* is an inclined surface, the direction of the charging roller 66 does not need to be defined between the right and the left when assembling the charging roller 66 to the charging roller bearings 67R and 67L. It is because either one of the connecting surface 66*k*2*a* or the connecting surface 66*k*2*b* may come into contact with the ridge line 67*a*4. Accordingly, manufacture is simplified.

In contrast, as a comparative example with respect to this example, the case where the connecting surfaces 66*k*5 (66*k*5*a* and 66*k*5*b*) extend substantially orthogonal to the end surface 66*a*5 of the charging roller shaft portion and the projecting surface 66*k*1 is illustrated in FIG. 10. In other words, the connecting surfaces 66*k*5 are parallel to the axial direction C (perpendicular to the direction of rotation M1).

In this case, the connecting surface 66*k*5*b* out of the connecting surfaces 66*k*5*a* and 66*k*5*b* is caught upon contact due to the rotation of the charging roller 66, whereby abrasion of the bearing 67 is accelerated. In addition, there is the case where the smooth rotation of the charging roller 66 may be impaired, so that an image failure may result.

Therefore, by forming the connecting surfaces 66*k*2 configured to connect the charging roller shaft portion end surface 66*a*5 and the projecting surface 66*k*1 into inclined surfaces as in this example, the charging roller 66 is preferably rotated smoothly while supplementing insufficient durability of the bearing member 67.

Here, in this example, an outer diameter of the shaft portion 66 is ϕ6 mm, the entire length in the axial direction C is 252.5 mm. An outer diameter and the entire length required in terms of function may be selected as needed.

A height 66L of the projecting surfaces from the end surface of the cylinder is 0.2 mm, a width 66M of the projecting surfaces is 1.5 to 2.5 mm, and an angle 66N of the inclined surfaces is 45 degrees. However, these values may be selected as needed within a range of minimum dimensions which do not cause any problem in terms of manufacture.

The inner diameter of the shaft portion 66*a* does not have to be a circular shape if it is not required in terms of function of the product and manufacture. In the process of bending the cylindrical shaped portion 66*a*2, for example, the projections and depressions may be formed inside (inner peripheral side) of the shaft portion 66*a*. Alternatively, a space does not have to be formed in the interior of the shaft portion 66*a*. For example, if an attempt is made to reduce the diameter of the shaft portion 66*a* with respect to the thickness of the metallic plate 66*a*1, an internal space of the shaft portion 66*a* may substantially disappeared if the cylindrical shaped portion 66*a*2 is bent to form the shaft portion 66*a*. Alternatively, filling the internal space of the shaft portion 66*a* by filling the interior of the shaft portion 66*a* with a reinforcing member in order to improve the strength of the shaft portion 66*a* is also conceivable. In other words, if the shaft portion 66*a* has a cylindrical shape, it does not necessarily mean that a space is formed in the interior of the shaft portion 66*a*, or a cross section of the internal space of the shaft portion 66*a* has a circular shape.

As illustrated in FIG. 12, the connecting surfaces 66*k*2 connecting the charging roller shaft portion end surface 66*a*5 and the projecting surface 66*k*1 may be a combination of a flat-shaped portion (inclined plane) and a curved portion (rounded surface). In FIG. 12, boundaries between the connecting surfaces 66*k*2 and the charging roller shaft portion end surface 66*a*5 are formed into a curved shape (rounded surface).

Not only the boundaries, the connecting surfaces 66*k*2 may be into a curved shape as a whole. This will be described in Example 2.

In this case of the configuration illustrated in FIG. 12, the angle 66N of the inclined surface was set to 45 degrees and a dimension 66R of the rounded surface was R0.2 mm. However, these values may be selected as needed within a range of minimum dimensions which do not cause any problem in terms of manufacture.

Dimensions of 66M, 66N, and 66R are dimensions when cutting the metallic plate 66*a*1 before being bent into a cylindrical shape, and may be changed to some extent at the time of bending into the cylindrical shape.

A projection 66*a*5 may be provided only at one end of the shaft portion 66*a* in the direction of axial line C depending on the manufacturing method.

Although the charging roller 66 is exemplified as the roller member in which this example is employed, this disclosure is not limited thereto. For example, the roller member which employs the configuration of this example may be the developing roller 32.

The charging roller 66 and the developing roller 32 are conductive rollers (having an electric resistance of approximately $10^8\Omega$ or lower), and are applied with a voltage at the time of image formation. However, the roller members having the metallic shaft 66*a* of this example are not limited thereto. The roller members to which the voltage is not applied at the time of image formation are also applicable, and a roller member covered with an insulative resilient member on an outer periphery of the metallic shaft 66*a*.

In the charging roller 66, the metallic shaft 66*a* is covered with the resilient member (the covering member). However, such a covering member is not essential. In other words, the simple term "roller member" in this disclosure may include the case of indicating the metallic shaft 66*a* itself.

There may be the case where the metallic shaft 66*a* itself is used as the roller member in the image forming apparatus, and there may be the case where the metallic shaft 66*a* provided with the covering member such as the resilient member mounted on the outer periphery thereof is used as the roller member.

EXAMPLE 2

Figure 13:
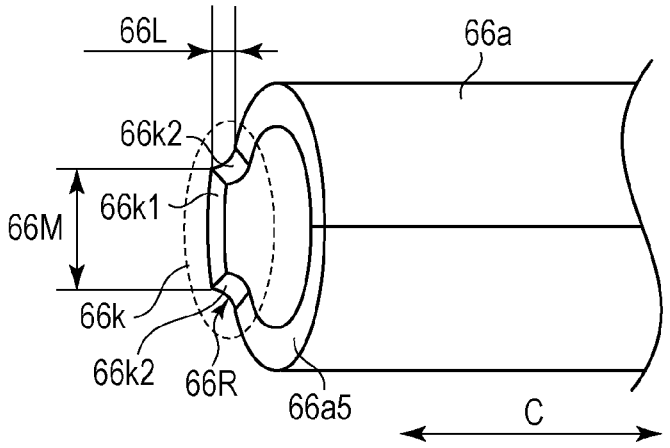
FIG. 13 is a detailed drawing illustrating the end portion of the shaft portion of the charging roller of Example 2.

Referring now to FIG. 13, a configuration of Example 2 will be described. FIG. 13 is a detailed drawing illustrating the end portion of the shaft portion 66*a* of the charging roller of Example 2.

Example 2 is the same as Example 1 other than the shape of the connecting surfaces 66*k*2 which connect the charging roller shaft portion end surface 66*a*5 and the projecting surface 66*k*1 projecting from the charging roller shaft portion end surface.

As illustrated in FIG. 13, the connecting surfaces 66*k*2 configured to connect the charging roller shaft portion end surface 66*a*5 and the projecting surface 66*k*1 projecting from the charging roller shaft portion end surface are formed into a inclined surface (rounded surface) having a curved shape.

The height 66L of the projecting surfaces from the end surface of the cylinder is 0.15 mm, the width 66M is 1.5 to 2.5 mm, and the dimension 66R of the rounded surface is R0.5 mm.

However, the height 66L of the projecting surface from the end surface of the cylinder and the width 66M of the projecting surface may be set within a range of minimum dimensions which have no problem in terms of manufacture, and the dimension 66R of the rounded surface may be set within a range of maximum dimensions which have no problem in terms of manufacture as needed.

In general, in order to simplify the press work, forming the connecting surface 66*k*2 into a flat-shaped inclined surface (inclined plane) as Example 1 is preferable for simplification of the press work. However, with the inclined surface (inclined curved surface) having a curves shape described in this example as well, there are effects in restraining abrasion of the charging roller bearing 67 and smoothening the rotation of the charging roller in the same manner as Example 1.

In Examples 1 and 2 described above, an example in which the charging roller of this disclosure is assembled to the process cartridge has been described. However, this disclosure is not limited thereto, and may be assembled to the image forming apparatus body in which a cartridge system is not employed. A configuration in which a minimum unit of only the charging roller can be mounted on and demounted from the process cartridge or the image forming apparatus body is also applicable.

Finally, summary of the advantageous effects of the Examples 1 and 2 disclosed in this application will be described below. In other words, according to the configurations of the respective examples, the bearing is protected from being worn easily by the rotation of the roller member. Alternatively, the roller member may be rotated smoothly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-074542 filed Mar. 31, 2014, which is hereby incorporated by reference herein in its entirety.

What is claimed is:

1. A roller member used in an image forming apparatus comprising: a metallic shaft, the metallic shaft including:

a cylindrical portion formed by bending a metallic plate so that one end portion and an other end portion of the metallic plate oppose each other; and a projecting portion projecting from an end surface of the cylindrical portion outward in an axial direction of the metallic shaft, wherein the projecting portion includes:

an end surface located at an end of the projecting portion in the axial direction; and an inclined surface configured to connect the end surface of the projecting portion and the end surface of the cylindrical portion, wherein the inclined surface is inclined with respect to the axial direction of the metallic shaft by extending outward from the end surface of the projecting portion in a circumference direction of the cylindrical portion.

2. The roller member according to claim 1, wherein the inclined surfaces are arranged on both sides of the end surface of the projecting portion.

3. The roller member according to claim 1, wherein the inclined surface includes a flat shaped portion.

4. The roller member according to claim 1, wherein the inclined surface includes a curved shaped portion.

5. The roller member according to claim 4, wherein boundary portions between the inclined surfaces and the end surface of the cylindrical portion have a curved shape.

6. The roller member according to claim 1, wherein the roller member is a charging roller configured to charge an image bearing member configured to bear an image.

7. The roller member according to claim 1, wherein the roller member is a developing roller configured to develop a latent image formed on the image bearing member.

8. The roller member according to claim 1, wherein the roller member includes a covering member configured to cover the metallic shaft.

9. A roller supporting mechanism used in an image forming apparatus comprising:

a roller member, the roller member comprising a metallic shaft including a cylindrical portion formed by bending a metallic plate so that one end portion and an other end portion of the metallic plate oppose each other and a projecting portion projecting from an end surface of the cylindrical portion outward in an axial direction of the metallic shaft;

a bearing portion configured to support the roller member, wherein the projecting portion includes an end surface located at an end of the projecting portion in the axial direction and an inclined surface configured to connect the end surface of the projecting portion and the end surface of the cylindrical portion, wherein the inclined surface is provided at least on a downstream side of the end surface of the projecting portion in a direction of rotation of the roller member, and wherein the inclined surface is inclined with respect to the axial direction of the metallic shaft by extending outward from the end surface of the projecting portion in a circumference direction of the cylindrical portion.

10. The roller supporting mechanism according to claim 9, wherein the inclined surface comes into contact with the bearing portion by the rotation of the roller member.

11. The roller supporting mechanism according to claim 9, wherein the roller supporting mechanism is mounted on and demounted from an apparatus body of the image forming apparatus.

12. The roller supporting mechanism according to claim 11, wherein the roller supporting mechanism is mounted on and demounted from the apparatus body as part of a process cartridge having an image bearing member configured to bear an image.

13. An image forming apparatus configured to form an image on a recording medium comprising:

an image bearing member configured to bear an image;

a roller member, the roller member comprising a metallic shaft including a cylindrical portion formed by bending a metallic plate so that one end portion and an other end portion of the metallic plate oppose each other and a projecting portion projecting from an end surface of the cylindrical portion outward in an axial direction of the metallic shaft;

a bearing portion configured to support the roller member, and a conveyance mechanism configured to convey the recording medium on which the image is recorded, wherein the projecting portion includes an end surface located at an end of the projecting portion in the axial direction and an inclined surface configured to connect the end surface of the projecting portion and the end surface of the cylindrical portion, wherein the inclined surface is provided at least on a downstream side of the end surface of the projecting portion in a direction of rotation of the roller member, and wherein the inclined surface is inclined with respect to the axial direction of the metallic shaft by extending outward from the end surface of the projecting portion in a circumference direction of the cylindrical portion.

* * * * *